US007231801B2

(12) United States Patent
Choi

(10) Patent No.: US 7,231,801 B2
(45) Date of Patent: Jun. 19, 2007

(54) PANEL CONVEYING APPARATUS FOR A PRESS LINE

(75) Inventor: Byeong Ho Choi, Ulsan (KR)

(73) Assignee: Hyundai Motor Company, Yangjae-Dong, Seocho-Ku, Seoul (KR)

( * ) Notice: Subject to any disclaimer, the term of this patent is extended or adjusted under 35 U.S.C. 154(b) by 522 days.

(21) Appl. No.: 10/839,853

(22) Filed: May 6, 2004

(65) Prior Publication Data

US 2005/0126253 A1 Jun. 16, 2005

(30) Foreign Application Priority Data

Dec. 11, 2003 (KR) ..... 10-2003-0090108

(51) Int. Cl.
*B21D 43/00* (2006.01)
*B21J 13/08* (2006.01)

(52) U.S. Cl. ..... 72/405.11; 72/405.08; 72/405.01; 414/749.1; 198/468.6

(58) Field of Classification Search ..... 72/405.11, 72/405.05, 405.01, 405.07, 405.08; 414/589, 414/749.1; 198/468.6; 254/122, 126
See application file for complete search history.

(56) References Cited

U.S. PATENT DOCUMENTS 1,780,265 A * 11/1930 Lolley ..... 254/126
2,071,470 A * 2/1937 Marlowe ..... 254/126
3,003,746 A * 10/1961 Gridley ..... 254/9 C
3,067,884 A * 12/1962 Williams ..... 414/497
4,457,657 A * 7/1984 Karis et al. ..... 414/790
4,638,610 A * 1/1987 Heikkinen ..... 52/109
5,012,879 A * 5/1991 Bienek et al. ..... 180/6.48
5,339,749 A * 8/1994 Hirose ..... 108/143

FOREIGN PATENT DOCUMENTS

JP 9038736 2/1997
JP 11090547 4/1999

* cited by examiner

*Primary Examiner*—Daniel C. Crane
(74) *Attorney, Agent, or Firm*—Morgan Lewis & Bockius LLP

(57) ABSTRACT

A panel conveying apparatus for a press line comprises a shuttle feeder and at least one panel position regulating device. The shuttle feeder is configured to be movable between presses. The panel position regulating device is mounted on the shuttle feeder and includes a panel guide unit, a rotating screw axis unit, and a link unit. The panel guide unit is configured to guide the panel. The rotating screw axis unit comprises a rotating screw axis and an actuator rotating the rotating screw axis. The link unit connects the panel guide unit and the rotating screw axis unit such that a vertical position of the panel guide unit is regulated in response to a rotation of the rotating screw axis.

10 Claims, 3 Drawing Sheets

PANEL CONVEYING APPARATUS FOR A PRESS LINE

FIELD OF THE INVENTION

Generally, the present invention relates to a panel conveying apparatus for a press line. More particularly, the panel conveying apparatus is capable of accurately positioning and regulating a position of a panel.

BACKGROUND OF THE INVENTION

Typically there are two types of press lines for forming panels, such as vehicle body panels. These press lines include a tandem press line and a transfer press line. In a tandem press line, a plurality of presses are linearly positioned and a separate automated apparatus, installed between the presses, conveys a formed panel between adjacent presses. In a transfer press line, a transfer device is mounted to one press. The transfer device conveys a formed panel through two-dimensional or three-dimensional continuous movements.

In both such press lines, a panel is inserted into a press by a loader prior to the panel being formed by the press. After the first press forms the panel, the formed panel is taken out of the press by an unloader and a shuttle feeder transfers the formed panel to a next press for a next operation. By repeating these processes, the panel is moved between the presses. This system is referred to as a loader-unloader-shuttle feeder system.

Typically, a panel position regulating device is provided on a shuttle feeder. The panel position regulating device includes a base plate that is mounted on the shuttle feeder and a loading jig mounted on the base plate. A plurality of mounting holes are formed in the base plate and a plurality of loading jigs, often having different lengths, are fixedly inserted into the mounting hole with bolts.

The configuration of the loading jig is predetermined according to the panel to be formed, such that, the formed panel can be loaded or unloaded while it maintains its equilibrium state. Therefore, the panel, that is formed by the first press is extracted from the first press by the unloader and is then loaded on the shuttle feeder. Next, the panel is conveyed to the second press by the shuttle feeder and is then loaded to the second press by the loader.

However a drawback of this system is that such conventional panel conveying systems need a plurality of determined loading jigs to accommodate different panels and the loading jigs must be changed whenever a formed panel is changed.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

An embodiment of the present invention provides a panel conveying apparatus for a press line which can position and regulate a position of a panel according to a shape of the panel.

In a preferred embodiment of the present invention, the panel conveying apparatus for a press line comprises a shuttle feeder and at least one panel position regulating device. The shuttle feeder is configured to be movable between presses. The panel position regulating device preferably is mounted on the shuttle feeder and comprises a panel guide unit, a rotating screw axis unit, and a link unit. The panel guide unit is configured to guide the panel. The rotating screw axis unit comprises a rotating screw axis and an actuator rotating the rotating screw axis. The link unit connects the panel guide unit and the rotating screw axis unit such that the panel guide unit is regulated vertically in response to rotation of the rotating screw axis.

It is preferable that the rotating screw axis unit further comprises a support frame that is mounted on the shuttle feeder and rotatably supports the rotating screw axis.

According to a preferred embodiment, the actuator is a motor. Further preferably, the motor is a step motor configured to regulate a number of rotations of the rotating screw axis.

It is preferable that the panel guide unit comprises a body in which a first guide slot is formed and that the link unit comprises a first nut member, a second nut member, a first link bar, and a second link bar. The first nut member and second nut member are respectively connected to the rotating screw axis such that the first and second nut members move in opposite directions in response to the rotation of the rotating screw axis. One end of each of the first link bar and second link bar is respectively pivotally connected to the first and second nut members. Guide pins are respectively provided at the other ends of the first and second nut members. The guide pins are slidably disposed in the first guide slot and first and second link bars are hingedly connected to each other through a hinge pin at predetermined positions. It is preferable that the first guide slot is formed along a horizontal direction. It is also preferable that a second guide slot is formed in the body of the panel guide unit along a vertical direction and that the hinge pin is slidably disposed in the second guide slot.

It is preferable that the first and second nut members respectively comprise a first female thread portion and a second female thread portion that are threaded in opposite directions. The rotating screw axis comprises a first male thread portion and a second male thread portion that are respectively configured to be coupled to the first and second female thread portions.

It is further preferable that the rotating screw axis unit further comprises a support frame that is mounted on the shuttle feeder and rotatably supports the rotating screw axis. The link unit further comprises a guide rail, a first support member, and a second support member. The guide rail is preferably mounted on the support frame. The first and second support members are slidably disposed on the guide rail and respectively support the first and second nut members.

It is preferred that the first support member is fixedly coupled to a lower portion of the first nut member, and that the second support member is fixedly coupled to a lower portion of the second nut member.

It is still further preferable that the panel guide unit comprise a body and a guide pin. The guide pin is upwardly extended from the body to guide a loading position of the panel. It is further preferable that the guide pin includes a tapered portion. It is still further preferable that the tapered portion is formed such that the lateral thickness of the guide pin gradually decreases as it approaches a top portion of the guide pin.

BRIEF DESCRIPTION OF THE DRAWINGS

The accompanying drawings, which are incorporated in and constitute a part of the specification, illustrate an embodiment of the invention, and, taken together with the description, serve to explain the principles of the invention, where.

DETAILED DESCRIPTION OF THE INVENTION

Figure 1:
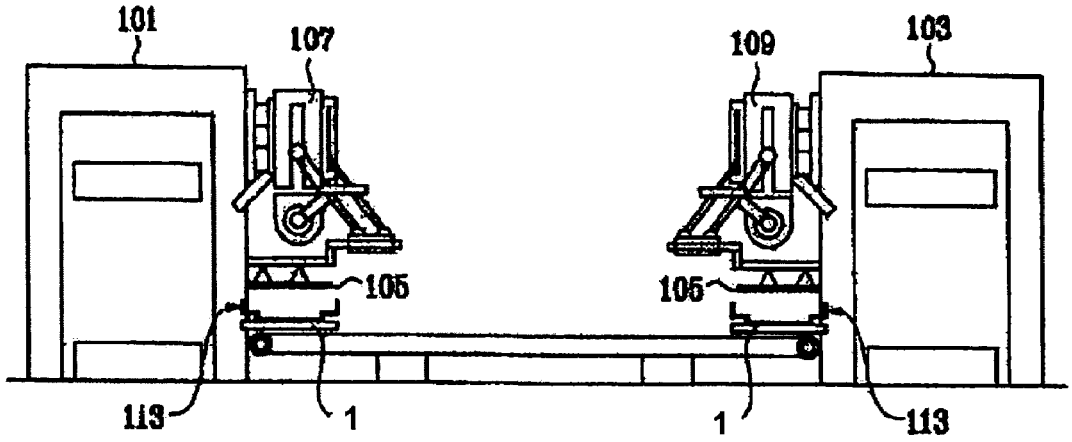
FIG. 1 shows a schematic of a typical configuration of a panel conveying system for a press line.

FIG. 1 shows a general loader-unloader-shuttle feeder type panel conveying system. The loader-unloader-shuttle feeder type panel conveying system includes an unloader 107 for unloading a formed panel 105 from a first press 101, a loader 109 for loading the formed panel to a second press 103, and a shuttle feeder 1 that is disposed between the unloader 107 and the loader 109. The shuttle feeder 1 is configured to be movable between the first and second presses 101 and 103.

Figure 2:
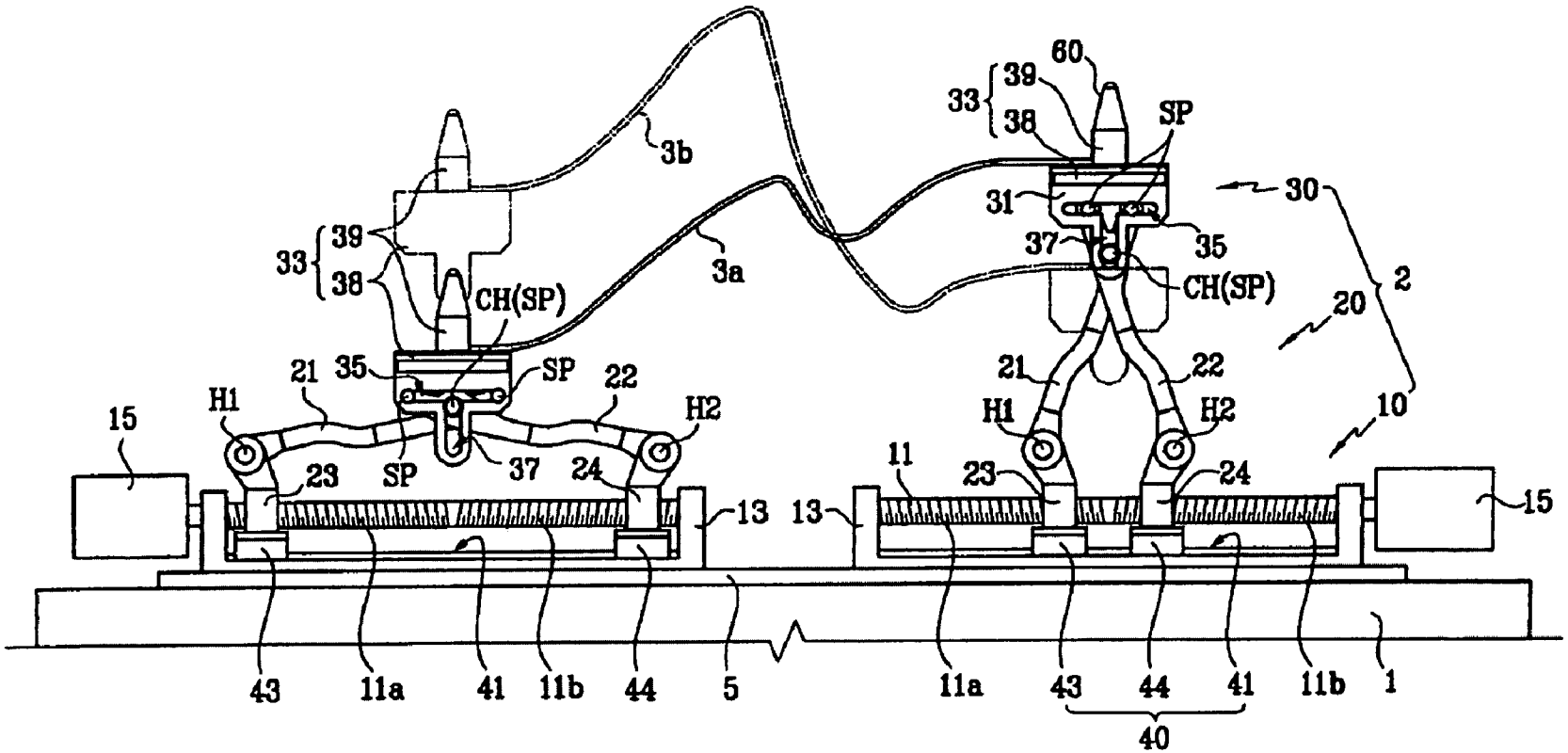
FIG. 2 shows an embodiment of a panel conveying apparatus for a press line according to a preferred embodiment of the present invention.

The panel conveying apparatus, according to FIG. 2, is configured for loading a formed panel 3*a* or 3*b* at desired positions (or postures) according to shapes of the formed panel 3*a* or 3*b* and then precisely conveying the formed panel 3*a* or 3*b* to a press for a subsequent forming process. The panel position regulating device 2 is configured to regulate positions of the formed panel 3*a* or 3*b* according to shapes of the formed panel 3*a* or 3*b*. If a plurality of panel position regulating devices 2 are positioned at predetermined positions on the shuttle feeder 1, the formed panel 3*a* or 3*b* can be securely loaded.

The shuttle feeder 1 is configured to be movable between presses of the press line. For example, if the shuttle feeder is disposed on a conveying system such as a roller system or a conveyer belt system, the shuttle feeder can be movable between the presses.

As shown in FIG. 2, according to a preferred embodiment of the present invention, the panel conveying apparatus for a press line comprises a shuttle feeder 1, which is configured to be movable between presses of a press line. The panel conveying apparatus preferably includes at least one panel position regulating device 2 that is mounted on the shuttle feeder 1.

As shown in FIG. 2, a base plate 5 is positioned on the shuttle feeder 1, and the panel position regulating device 2 is mounted on the base plate 5. The panel position regulating device 2 comprises a panel guide unit 30, a rotating screw axis unit 10, and a link unit 20. The panel guide unit 30 is configured to guide the formed panel 3*a*.

The link unit 20 connects the panel guide unit 30 and the rotating screw axis unit 10 such that a vertical position of the panel guide unit 30 is regulated in response to an operation of the rotating screw axis unit 10. The rotating screw axis unit 10 comprises a rotating screw axis 11 and an actuator 15 to rotate the rotating screw axis 11.

The rotating screw axis 11 is rotatably mounted to a support frame 13 that is disposed on the base plate 5. That is, both ends of the rotating screw axis 11 are rotatably connected to the support frame 13, so that the support frame 13 rotatably supports the rotating screw axis 11.

The actuator 15 is connected to the rotating screw axis 11 such that the actuator 15 can rotate the rotating screw axis 11. According to an embodiment, the actuator 15 can be, for example, a motor. For example, the actuator 15 can be a step motor configured to regulate a number of rotations of the rotating screw axis.

According to a preferred embodiment, the actuator 15 is controlled by control signals of a control unit to rotate the rotating screw axis 11. In an embodiment, the control unit can comprise a processor and associated hardware as may be selected and programmed by a person of ordinary skill in the art based on the teachings of the present invention.

Figure 3:
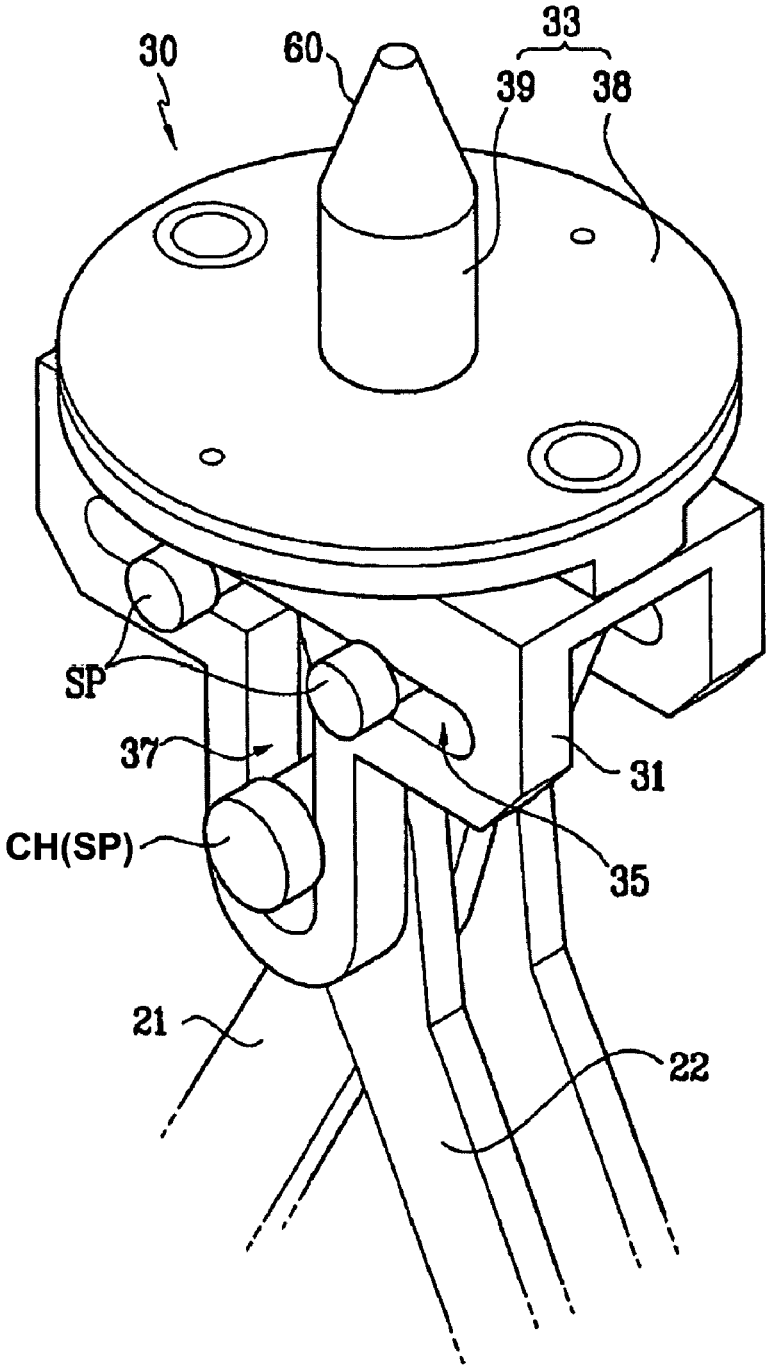
FIG. 3 is a perspective view of a panel guide unit of the panel conveying apparatus of FIG. 2.

According to FIG. 3, the panel guide unit 30 comprises a body 31 and a guide pin 39. The body 31 includes a circular plate 38, and the guide pin 39 is preferably provided on the circular plate 38. The guide pin 39 is upwardly protruded from a top surface of the body 31, and is configured to guide loading positions of the formed panel 3*a* or 3*b*. The guide pin 39 is provided with a tapered portion 60. The tapered portion 60 is formed such that a lateral thicknesses of the guide pin 39 gradually decreases on approach to a top portion of the guide pin 39. Because of the tapered portion 60, the panel 3*a* can be loaded more easily onto the panel guide unit 30.

A first guide slot 35 and a second guide slot 37 are respectively formed in the body 31 of the panel guide unit 30. Preferably, the first guide slot 35 is formed along a horizontal direction, and the second guide slot 37 is formed along a vertical direction.

The link unit 20 comprises a first nut member 23, a second nut member 24, a first link bar 21, and a second link bar 22. The first and second nut members 23 and 24 are respectively coupled to the rotating screw axis 11 such that the first and second nut members 23 and 24 move in opposite directions in response to the rotation of the rotating screw axis 11.

A right hand female thread is formed in one of the first and second nut members 23, 24, a left hand female thread is formed in the other of the first and second nut members 23, 24, and corresponding male threads are formed on the rotating screw axis 11. Due to the different right and left hand threads on respective nuts and on the screw axis, the first and second nut members 23 and 24 can move in opposite directions in response to the rotation of the rotating screw axis 11.

According to an embodiment, as shown in FIG. 2, lower ends (lower with respect to the figure on the page) of the first and second link bars 21 and 22 are respectively hingedly coupled to the first and second nut members 23 and 24 through hinge pins H1 and H2. The first and second link bars 21 and 22 are hingedly coupled together at predetermined positions in a cross manner through a hinge pin CH(SP). At the same time, the hinge pin CH(SP) is slidably disposed in the second guide slot 37.

Guide pins SP are respectively provided at upper ends (upper with respect to the figure on the page) of the first and second link bars 21 and 22, and the guide pins SP are slidably disposed in the first guide slot 35. In addition, a guide means 40 is provided to support and guide the first and second nut members 23 and 24. The guide means 40 preferably comprises a guide rail 41, a first support member 43, and a second support member 44.

The guide rail 41 is disposed on the support frame 13, and the first and second support members 43 and 44 are slidably disposed on the guide rail 41. The first support member 43 is fixedly coupled to a lower portion of the first nut member 23, and the second support member 44 is fixedly coupled to a lower portion of the second nut member 24. Accordingly, when the first and second nut members 23 and 24 move, the first and second support members 43 and 44 slide on the guide rail 41. Because the first and second nut members 23 and 24 are supported by the first and second support members 43 and 44 in this manner, the rotating screw axis 11 can be prevented from being downwardly bent, where downward refers to the downward direction with respect to the figure on the page.

Operations of the panel conveying apparatus according to the preferred embodiment of the present invention will be explained hereinafter.

If the rotating screw axis 11 is rotated in a first direction and, correspondingly, the first and second nut members 23 and 24 become displaced remote from each other, lower ends and upper ends of the first and second link bars 21 and 22 also become displaced from each other. Accordingly, the panel guide unit 30 moves in a downward direction, where downward refers to the downward direction with respect to the figure on the page.

Alternatively, if the rotating screw axis 11 is rotated in a second direction, correspondingly, the first and second nut members 23 and 24 will become positioned close to each other. Consequently, lower and upper ends of the first and second link bars 21 and 22 also become positioned close to each other and the panel guide unit 30 moves in a upward direction, where upward refers to the upward direction in the figure on the page.

As a result, a vertical position of the panel guide unit 30 can be regulated by rotating the rotating screw axis 11 using the actuator 15.

As shown in FIG. 2, the panel guide unit 30 of the left-side panel position regulating device 2 is positioned at a lowest position thereof, and the panel guide unit 30 of the right-side panel position regulating device 2 is positioned at a higher position, where lower and height refer to the positions of the panel guide unit 30, as shown in FIG. 2, with respect to the figure on the page.

By manipulating the panel position regulating device 2 the panel guide unit 30 can be positioned at an optimal position in accord with particular shapes of the formed panel 3*a* or 3*b*.

According to an embodiment of the present invention, the vertical position of the panel guide unit 30 can be regulated, so that the panel conveying apparatus can be used for various types of panels, panels of various shapes, and the like. That is, the panel conveying apparatus for a press line can optimally guide and convey the formed panels according to the shapes of the panel.

Although preferred embodiments of the present invention have been described in detail herein, it should be clearly understood that many variations and/or modifications of the basic inventive concepts herein taught which may appear to those of ordinary skill in the present art are intended to fall within the spirit and scope of the present invention, as defined in the appended claims.

What is claimed is:

1. A panel conveying apparatus for a press line, comprising:

a shuttle feeder configured to be movable between presses; and at least one panel position regulating device that is mounted on the shuttle feeder, wherein said panel position regulating device comprises:

a panel guide unit configured to guide a panel;

a rotating screw axis unit comprising a rotating screw axis and an actuator rotating the rotating screw axis; and a link unit connecting the panel guide unit and the rotating screw axis unit such that a vertical position of the panel guide unit is regulated in response to a rotation of the rotating screw axis, wherein the panel guide unit comprises a body in which a first guide slot is formed, wherein the link unit comprises:

a first nut member and a second nut member respectively connected to the rotating screw axis such that the first and second nut members move in opposite directions in response to rotation of the rotating screw axis; and a first link bar and a second link bar with one end of each being respectively hingedly connected to the first and second nut members, with guide pins respectively provided at opposing ends of the first and second nut members and being slidably disposed in the first guide slot, the first and second link bars being hingedly connected to each other through a hinge pin positioned at predetermined positions, and wherein a second guide slot is formed in the body of the panel guide unit along a vertical direction and the hinge pin is slidably disposed within the second guide slot.

2. A panel conveying apparatus for a press line, comprising:

a shuttle feeder configured to be movable between presses; and at least one panel position regulating device that is mounted on the shuttle feeder, wherein said panel position regulating device comprises:

a panel guide unit configured to guide a panel;

a rotating screw axis unit comprising a rotating screw axis and an actuator rotating the rotating screw axis; and a link unit connecting the panel guide unit and the rotating screw axis unit such that a vertical position of the panel guide unit is regulated in response to a rotation of the rotating screw axis, wherein the panel guide unit comprises a body in which a first guide slot is formed, and wherein the link unit comprises:

a first nut member and a second nut member respectively connected to the rotating screw axis such that the first and second nut members move in opposite directions in response to rotation of the rotating screw axis; and a first link bar and a second link bar with one end of each being respectively hingedly connected to the first and second nut members, with guide pins respectively provided at opposing ends of the first and second nut members and being slidably disposed in the first guide slot, the first and second link bars being hingedly connected to each other through a hinge pin positioned at predetermined positions, wherein the rotating screw axis unit further comprises a support frame that is mounted on the shuttle feeder and rotatably supports the rotating screw axis, and wherein the link unit further comprises:

a guide rail mounted on the support frame; and a first support member and a second support member, wherein both said first and said second support members are slidably disposed on the guide rail and respectively support the first and second nut members.

3. The panel conveying apparatus of claim 2, wherein the rotating screw axis unit further comprises a support frame that is mounted on the shuttle feeder and rotatably supports the rotating screw axis.

4. The panel conveying apparatus of claim 2, wherein the actuator is a motor.

5. The panel conveying apparatus of claim 4, wherein the motor is a step motor configured to regulate a number of rotations of the rotating screw axis.

6. The panel conveying apparatus of claim 2, wherein the first guide slot is formed along a horizontal direction.

7. The panel conveying apparatus of claim 2, wherein the first nut member comprises a first female thread portion and the second nut member comprises a second female thread portion, wherein each of said first and second thread portions are threaded in opposite directions and wherein the rotating screw axis comprises a first male thread portion and a second male thread portion respectively configured to couple with the first and second female thread portions.

8. The panel conveying apparatus of claim 2, wherein the first support member is fixedly coupled to a lower portion of the first nut member and the second support member is fixedly coupled to a lower portion of the second nut member.

9. A panel conveying apparatus for a press line, comprising:

a shuttle feeder configured to be movable between presses; and at least one panel position regulating device that is mounted on the shuttle feeder, wherein said panel position regulating device comprises:

a panel guide unit configured to guide a panel;

a rotating screw axis unit comprising a rotating screw axis and an actuator rotating the rotating screw axis; and a link unit connecting the panel guide unit and the rotating screw axis unit such that a vertical position of the panel guide unit is regulated in response to a rotation of the rotating screw axis, wherein the panel guide unit comprises:

a body; and a guide pin that is upwardly extended from the body to guide a loading position of the panel, wherein the guide pin comprises a tapered portion.

10. The panel conveying apparatus of claim 9, wherein the tapered portion is formed such that a lateral thicknesses of the guide pin gradually decreases as it approaches a top portion of the guide pin.

* * * * *